US005165781A

United States Patent [19]

Orak

[11] Patent Number: 5,165,781

[45] Date of Patent: Nov. 24, 1992

[54] FLASHLIGHT WITH COLOR PRODUCING CHAMBERS

[76] Inventor: Zeki Orak, 4373 - 25th St., San Francisco, Calif. 94114

[21] Appl. No.: 802,998

[22] Filed: Dec. 5, 1991

[51] Int. Cl.[5] ..... F21L 7/00; F21V 9/12

[52] U.S. Cl. ..... 362/186; 362/101; 362/202; 362/318; 40/555; 446/267; 446/485

[58] Field of Search ..... 362/101, 182, 186, 202, 362/205, 318, 329, 331, 399, 102; 40/406, 555; 446/267, 485

[56] References Cited

U.S. PATENT DOCUMENTS

| | | | |
|---|---|---|---|
| 2,931,136 | 4/1960 | Loewy | 446/267 |
| 3,383,675 | 5/1968 | Allardice et al. | 362/186 |
| 3,392,482 | 7/1968 | Nathan | 446/267 |
| 3,964,194 | 6/1976 | Gugeler | 40/406 |
| 4,395,835 | 8/1983 | Schneider | 40/406 |
| 4,507,087 | 3/1985 | Stevenson | 446/267 |
| 4,600,974 | 7/1986 | Lew et al. | 362/102 |
| 4,858,083 | 8/1989 | Wakimoto | 362/101 |
| 5,105,343 | 4/1992 | Wakimoto | 362/202 |

FOREIGN PATENT DOCUMENTS 1363645 8/1974 United Kingdom ..... 40/406

*Primary Examiner*—Ira S. Lazarus
*Assistant Examiner*—Y. Quach
*Attorney, Agent, or Firm*—Limbach & Limbach

[57] ABSTRACT

A flashlight including a handle for receiving a power supply and a light source releasably mounted to the handle for emitting light. An exterior transparent cup is coupled to the handle and a middle transparent cup is coupled to the handle. The second transparent cup is positioned intermediate the first transparent cup and the light source. The exterior transparent cup and the middle transparent cup define a outer chamber therebetween for receiving colored fluid therein. An interior transparent cup is coupled to the handle and positioned between the middle transparent cup and the light source. The middle transparent cup and exterior transparent cup define an inner chamber for receiving colored fluid. Accordingly, the light emitted from the light source passes through the colored fluids and colored light is emitted from the exterior transparent cup.

16 Claims, 2 Drawing Sheets

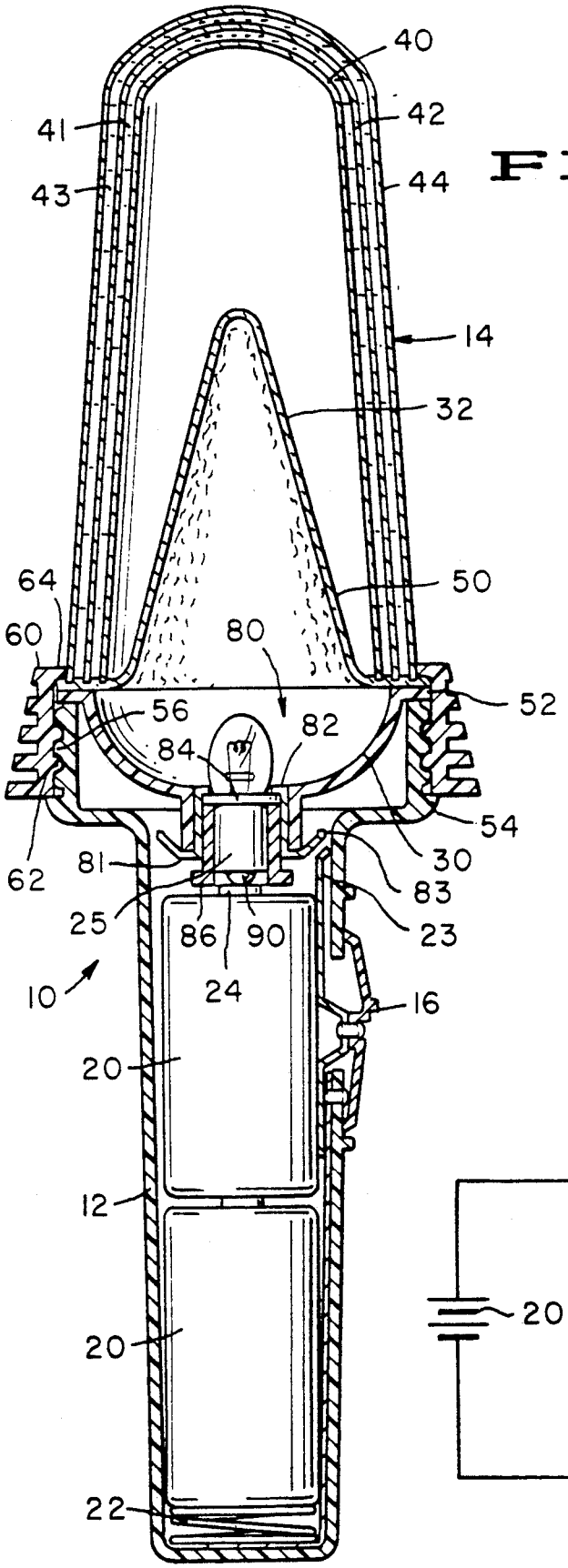
FIG. 3
FIG. 4
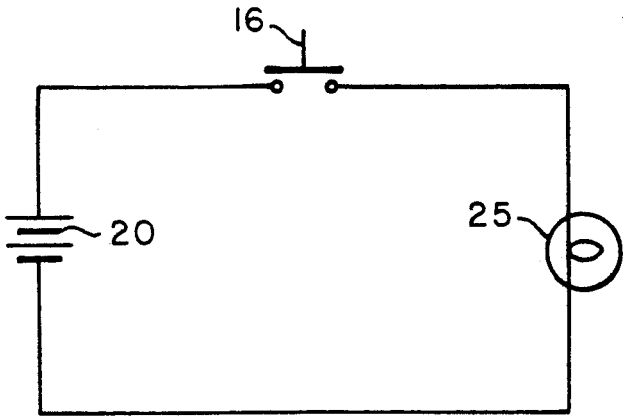

FLASHLIGHT WITH COLOR PRODUCING CHAMBERS

BACKGROUND OF THE INVENTION

This invention is directed to a novel amusement device and, in particular, to a flashlight with color producing chambers that emit a variety of colored lights in a variety of directions and provides distinct types of play value.

While toy flashlights have taken many forms, toy flashlights are known in the prior art as exemplified in U.S. Pat. No. 3,877,171. U.S. Pat. No. 3,877,171 is directed to a toy flashlight having a reflector rotationally mounted on a longitudinal axis, such that when spun, the reflector produces a rotating beam of light. The excitement of such a flashlight or one with a rotating beam will dissipate quickly due, in large measure, to the absence of any variations in the value that will retain the attention of the child over long time periods.

The present invention overcomes these disadvantages by providing a flashlight with a liquid color cup to receive multicolored immiscible liquids therein. The multicolored immiscible liquids form abstract swirling patterns and the light irradiated therethrough is in similar multicolored moving swirling patterns. Accordingly, an improved toy flashlight that emits multiple colors, in multiple random patterns, is desired.

SUMMARY OF THE INVENTION

Generally speaking, in accordance with the instant invention, a toy flashlight is provided. The toy flashlight includes a handle housing for receiving a power supply. A light source is releasably mounted to the handle housing. The light source is adapted to be electrically coupled to the power supply and emit light in a direction away from the handle. A first transparent enclosure is adapted to be mounted to the handle and surround the light source. A second transparent enclosure is adapted to be mounted to the handle intermediate the first transparent enclosure and the light source. The first and second transparent enclosures define a cavity therebetween for receiving colored fluid of at least two colors therein. A third transparent enclosure is mounted to the handle and positioned intermediate the second transparent enclosure and the light source. The second transparent enclosure and third transparent enclosure define a second cavity therebetween for receiving a different colored fluid than is provided within the first cavity. Accordingly, when the light source is illuminated, colored light emanates from the first transparent enclosure, the light filtering through the colored fluid in the first cavity and second cavity and being varied accordingly.

In one embodiment, liquids of varying colors are disposed within each cavity, so that the liquids do not mix. Accordingly, four separate colors exist within the two cavities, thereby exhibiting a multiplicity of colors greater than four, since each of the four colors suspended in the cavity would appear alone, as well as appearing in distinct combinations.

Accordingly, it is an object of the instant invention to provide an improved amusement device in the form of a toy flashlight.

A further object of the instant invention is to provide an abstract illuminating toy that captivates a child's attention and allows the child to use his imagination in creating a variety of games to be played therewith.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 3 is a cross-sectional view taken along line 3—3 of FIG. 1; and FIG. 4 is a simple flashlight circuit diagram.

DETAILED DESCRIPTION OF THE PREFERRED EMBODIMENTS

Figure 1:
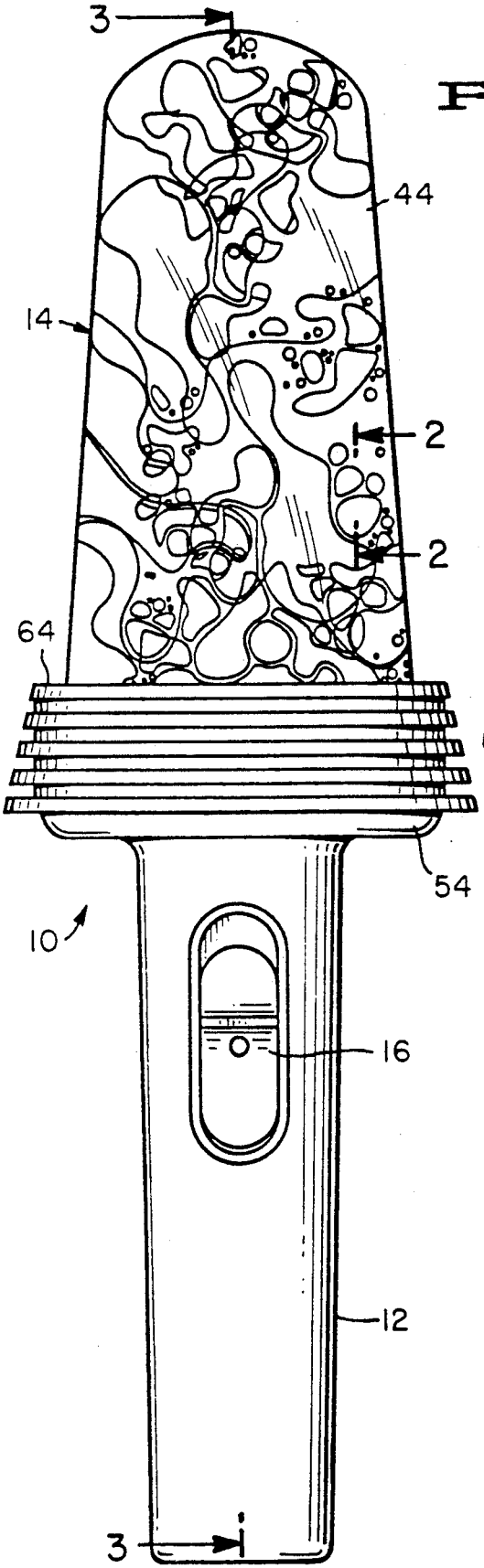
FIG. 1 is a front elevational view of a flashlight constructed in accordance with the invention.
Figure 2:
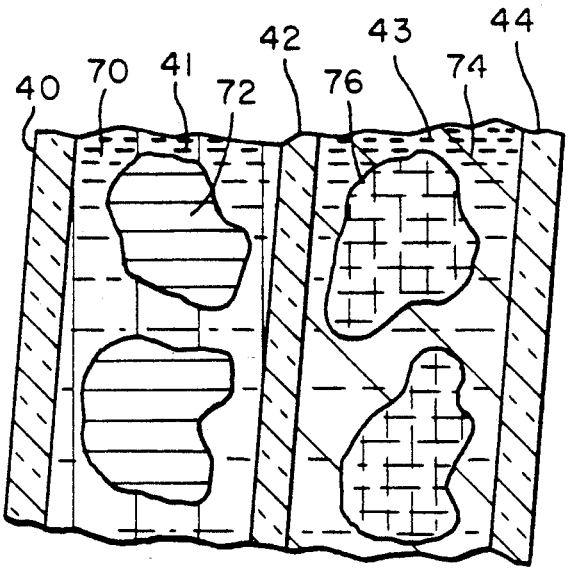
FIG. 2 is a fragmentary cross-sectional view taken along line 2—2 of FIG. 1.

Reference is first made to FIG. 1, wherein a toy flashlight, generally indicated as 10, is depicted. Flashlight 10 includes a handle assembly 12 and a cup-shaped light filter assembly 14 for containing liquids 70–76. A light source assembly 80 is disposed within cup-shaped light filter assembly 14.

Handle assembly 12 is adapted to receive batteries 20 and includes on/off switch 16 coupled between light assembly 80 and batteries 20 (FIG. 4) to selectively illuminate light assembly 80. In an exemplary embodiment, handle, assembly 12 is formed of a thermoplastic material such as polyvinyl chloride (PVC) or the like. Handle assembly 12 includes a negative battery connection terminal 22 forming the common contact with batteries 20 and a positive post 24 of battery 20 contacting a light bulb 25 of light assembly 80. Negative terminal 22 is electrically connected to switch 16. Switch 16 includes a common contact 23. Switch 16 is movable between a first position in which common contact 23 is not in electrical contact with light bulb 25 and a second position, wherein common contact 23 is in electrical contact with light bulb 25.

Light assembly 80 includes a reflector 30 which is electro-coated with a reflective material and secured between handle housing assembly 12 and a flange portion 52 of diffusion cup 32, which is described in greater detail below. A conductive contact cup 81 is force fit into an opening in reflector 30. Light bulb 25 is inserted into conductive contact cup 81 such that flange 82 of conductive contact cup 81 bears against flange 84 of light bulb 25. Bulb holder 86 is force fit between contact cup 81 and light bulb 25 to maintain light bulb 25 in place, such that positive pole 24 of battery 20 is maintained in constant contact with anode 90 of light bulb 25. Peripheral lip 83 of conductive contact cup 81 is disposed in contact with common contact 23 when common contact 23 is displaced into the second position by movement of switch 16 turning bulb 25 ON.

Cup-shaped light filter assembly 14 includes a conically-shaped translucent diffusion cup 32 that diffuses the light evenly. Diffusion cup 32 rests on reflector 30 and is positioned intermediate light bulb 25 and an interior cup 40 which rests on diffusion cup 32. Further, cup 40 is positioned intermediate diffusion cup 32 and a middle cup 42 which rests on diffusion cup 32. Middle cup 42 is positioned intermediate interior cup 40 and an exterior cup 44 which rests on diffusion cup 32. Since diffusion cup 32 diffuses light evenly, light emitted from light bulb 25 is projected evenly to cup 40. Metallic reflector 30 is further provided to reflect light from light bulb 25 away from handle assembly 12 and toward diffusion cup 32. Each of the interior, middle, and exterior cups define separate transparent enclosures.

Cup 40 and cup 42 are sized to define an inner chamber 41 therebetween for storing fluid therein. Chamber 41 is filled with a transparent red liquid 70 and an immiscible transparent blue liquid, 72 suspended in liquid 70. Further, cup 42 and exterior cup 44 define a outer chamber 43 therebetween for containing a transparent green liquid 74 and an immiscible yellow liquid 76 suspended in liquid 74. The colors are yellow, green, blue and red by way of example. However, each of the liquids in chamber 43 should be of a different color than the liquids in chamber 41 and he different colored liquids within a single chamber are immiscible.

The liquids in each respective chamber 41, 43 are immiscible with the other liquid in the respective chamber. Typically, the immiscibility is due to a difference in polarity between the liquids. For example, liquid 70 can be polar and liquid 72 can be nonpolar. Alternatively, liquid 72 can be polar and liquid 70 can be nonpolar. The same is true for the liquids in chamber 43. Preferably, one liquid forms the primary liquid 70, 74 and the second liquid forms a secondary liquid 72, 76. The primary and secondary liquids should have similar densities such that they will not be prone to float on each other. The closer the liquids are in density, the longer they will form intermixed globules. The larger the variation in density, the quicker they will separate and the lighter liquid will float upon the heavier liquid. Further, the secondary liquid should have strong cohesive properties, such that it forms large globules and does not form suspensions or emulsions.

The liquids act as filters to change the color of the light that emanates from cup 44. Accordingly, when a user has bulb 25 illuminated and is moving flashlight 10, liquids 70–76 in chambers 41 and 43 are caused to swirl producing a pattern of a multiplicity of different colors. Further, the colors seen would not only be the four colors that are contained in the liquids, but also blends of the colors in chamber 41 and the colors in chamber 43. Accordingly, there are many different color combinations that will apparently be emitted from cup 44.

Diffusion cup 32 includes a conically-shaped cup portion 50 and flange portion 52. Flange portion 52 is coupled to cups 40, 42 and 44 providing liquid tight chambers such that the fluids in chambers 41 and 43 are locked within respective chambers 41, 43. Cups 40, 42 and 44 may be coupled to flange portion 52 by way of a tongue and groove frictional fit, or may be coupled thereto by an adhesive. Further, since diffusion cup 32 and cups 40, 42 and 44 are all formed of thermoplastic material, the thermoplastic may be heated such that there is actual cohesion between diffusion cup 32 and cups 40, 42 and 44.

Flange portion 52 of diffusion cup 32 lies flush against reflector 30 which in turn rests upon an upper portion 54 of handle 12. Upper portion 54 of handle assembly 12 is provided with external threads 56 thereon. Further, a coupling member 60 is provided with an internally threaded body 62 and an inwardly extending flange 64 which contacts flange portion 52 of diffusion cup 32. Accordingly, when coupling member 60 is screwed onto upper portion 54 of handle assembly 12, flange 64 engages flange portion 52, thereby coupling diffusion cup 32 and cups 40, 42 and 44 to handle assembly 12.

With specific reference to FIG. 4, a simple circuit is depicted to illustrate the actual flashlight circuit. When switch 16 is moved to the second, closed position, battery 20 is in electrical contact with light bulb 25 and light bulb 25 becomes illuminated. However, when switch 16 is not in the first, open position, there is an open circuit between battery 20 and light bulb 25 such that light bulb 25 will not become illuminated. When light bulb 25 is illuminated, light is projected through the changing colored patterns provided by liquids 70–76 providing ever changing patterns of light.

By providing a toy flashlight utilizing light filters of transparent multiple immiscible liquids, such that when a light source shines through the colored liquids, the light emanating therefrom takes on the color of the liquid that it shines through, the flashlight captures the attention of a child. Accordingly, a child may shake the device or twirl the device or move it in many directions to reform many different colored swirling patterns or effects therefrom. The secondary liquid floats about in the primary liquid in globules of random size and shape. As the secondary liquid moves about in the first chamber, the secondary liquid in the second chamber is also moving about. Accordingly, many different color combinations are formed. The individual colored liquids form filters for the light. Accordingly, as the secondary fluids travel about in their respective chambers, the light illuminated therefrom constantly changes. Accordingly, there are four (4) fluids moving about to form at least eight (8) colors. An air gap may also be provided in the cavity to allow single colors to shine through as well as to allow for expansion of the liquid. By providing a flashlight containing bright colors that can form multiple abstract configurations, a toy which can be used for a variety of games while allowing a child to use his imagination to create multiple games, illusions or effects from a single device is provided. Accordingly, this device provides enhanced play value for a child.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A flashlight comprising handle means for receiving a power supply therein, light source means mounted in said handle means for emitting light, light filter means secured to said handle means, said light filter means including an exterior transparent enclosure means, middle transparent enclosure means positioned intermediate said exterior transparent enclosure means and said light source means, said exterior transparent enclosure means and said middle transparent enclosure means defining an outer chamber therebetween for receiving a transparent colored fluid therein, said light filter means including an interior transparent enclosure means and positioned intermediate said middle transparent enclosure means and said light source means, and said middle transparent enclosure means and said interior transparent enclosure means defining an inner chamber for receiving another transparent colored fluid therein, said transparent colored fluids being of different colors and adapted to filter said light.

2. The flashlight as claimed in claim 1, further including diffusion means for diffusing the light from said light source means and providing substantially uniform illumination.

3. The flashlight as claimed in claim 2, wherein exterior, middle and interior transparent enclosure means are coupled to said diffusion means.

4. The flashlight as claimed in claim 3, wherein said diffusion means and said exterior, middle and interior transparent enclosure means are coupled by adhesive.

5. The flashlight as claimed in claim 2, wherein said diffusion means is formed of thermoplastic.

6. The flashlight as claimed in claim 1, wherein said exterior, middle and exterior transparent enclosure means are formed of thermoplastic.

7. The flashlight as claimed in claim 1, wherein said handle means is formed of thermoplastic.

8. The flashlight as claimed in claim 1, further including a light reflector to reflect light from said light source means toward said interior, middle, exterior transparent enclosure means.

9. The flashlight as claimed in claim 1, further including coupling means for coupling said handle means to said exterior, middle and interior transparent enclosure means.

10. The flashlight as claimed in claim 9, wherein said coupling means includes an inwardly extending flange at one end and internal threads, said handle means further including external threads to engage said internal threads of said coupling means.

11. The flashlight as claimed in claim 1, wherein said outer chamber includes two transparent fluids of different colors with said two transparent fluids being immiscible.

12. The flashlight as claimed in claim 1, wherein said inner chamber includes two transparent fluids of different colors with said two transparent fluids being immiscible.

13. The flashlight as claimed in claim 12, wherein said outer chamber includes two transparent fluids of different colors with said two transparent fluids being immiscible.

14. The flashlight as recited in claim 13, wherein the colors of each of the transparent fluids in the inner and outer chambers are different.

15. A flashlight comprising handle means for receiving a power supply therein, light source means mounted in said handle means for emitting light, light filter means secured to said handle means, said light filter means including an exterior transparent enclosure means, middle transparent enclosure means positioned intermediate said exterior transparent enclosure means and said light source means, said exterior transparent enclosure means and said middle transparent enclosure means defining an outer chamber therebetween for receiving two transparent, immiscible fluids therein, with said two transparent, immiscible fluids in said outer chamber being of different colors, said light filter means including an interior transparent enclosure means and positioned intermediate said middle transparent enclosure means and said light source means, and said middle transparent enclosure means and said interior transparent enclosure means defining an inner chamber for receiving two other transparent, immiscible fluids therein, with said two other transparent immiscible fluids in said inner chamber being of different colors, and with all of said transparent fluids being adapted to filter said light.

16. The flashlight as recited in claim 15, wherein the colors of each of the transparent fluids in the inner and outer chambers are different.

* * * * *